US007588012B2

(12) United States Patent
Gibson et al.

(10) Patent No.: US 7,588,012 B2
(45) Date of Patent: Sep. 15, 2009

(54) FUEL SYSTEM HAVING VARIABLE INJECTION PRESSURE

(75) Inventors: Dennis H. Gibson, Chillicothe, IL (US); Mark F. Sommars, Sparland, IL (US); Jinhui Sun, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 588 days.

(21) Appl. No.: 11/269,704

(22) Filed: Nov. 9, 2005

(65) Prior Publication Data

US 2007/0102543 A1 May 10, 2007

(51) Int. Cl.
*F02M 37/04* (2006.01)

(52) U.S. Cl. ..... 123/304; 123/447; 123/458

(58) Field of Classification Search ..... 123/304, 123/447, 458

See application file for complete search history.

(56) References Cited

U.S. PATENT DOCUMENTS

| | | | | |
|---|---|---|---|---|
| 6,491,017 | B1 * | 12/2002 | Mahr et al. | 123/299 |
| 6,619,263 | B1 | 9/2003 | Mahr et al. | |
| 6,883,498 | B2 | 4/2005 | Braun et al. | |
| 6,962,141 | B2 | 11/2005 | Kern | |
| 2004/0076530 | A1 | 4/2004 | Spoolstra et al. | |
| 2004/0159716 | A1 | 8/2004 | Azam et al. | |
| 2004/0163626 | A1 | 8/2004 | Stockner et al. | |
| 2004/0168673 | A1 | 9/2004 | Shinogle | |
| 2005/0039724 | A1 | 2/2005 | Hshida et al. | |
| 2005/0115544 | A1 | 6/2005 | Kim | |
| 2005/0126545 | A1 | 6/2005 | Shafer et al. | |

FOREIGN PATENT DOCUMENTS

| | | | |
|---|---|---|---|
| DE | 36 18 447 | A1 | 12/1987 |
| DE | 41 18 237 | A1 | 12/1991 |
| DE | 195 20 036 | A1 | 12/1995 |
| DE | 695 07 574 | T2 | 6/1999 |
| DE | 695 05 741 | T2 | 7/1999 |
| DE | 199 10 589 | A1 | 9/2000 |
| DE | 199 39 422 | A1 | 3/2001 |
| DE | 101 51 885 | A1 | 5/2003 |
| EP | 0 711 914 | A1 | 5/1996 |
| EP | 0 982 492 | A2 | 3/2000 |
| EP | 1 199 467 | A2 | 4/2002 |

OTHER PUBLICATIONS

B. Mahr (Robert Bosch GmbH, Diesel Systems, DS-NF/SBN, Postfach 30 02 20, D-70469 Stuttgart, Germany), "Future and Potential of Diesel Injection Systems", Thiesel 2002 Conference on Thermo- and Fluid-Dynamic Process in Diesel Engines, Sep. 2002, pp. 5-17, Valencia, Spain.

R. Holtman, Research Disclosure Journal, Publication No. 487063, Nov. 10, 2004

PCT International Search Report, File Reference 04-474, PCT/US2006/035061; International Filing Date: Aug. 9, 2006; Applicant: Caterpillar, Date of Mailing: Dec. 22, 2006.

* cited by examiner .

*Primary Examiner*—Erick Solis
(74) *Attorney, Agent, or Firm*—Finnegan, Henderson, Farabow, Garrett & Dunner

(57) ABSTRACT

A fuel injector for a work machine is disclosed. The fuel injector has nozzle member having at least one orifice and a needle valve element having a tip end. The needle valve element is axially movable to selectively allow and block fuel flow through the at least one orifice with the tip end. The fuel injector also has at least one supply passageway in communication with the tip end of the needle valve and a variable restrictive device disposed within the at least one supply passageway.

20 Claims, 3 Drawing Sheets

FUEL SYSTEM HAVING VARIABLE INJECTION PRESSURE

TECHNICAL FIELD

The present disclosure is directed to a fuel system and, more particularly, to a fuel system having variable injection pressure capabilities.

BACKGROUND

Common rail fuel injectors provide a way to introduce fuel into the combustion chambers of an engine. Typical common rail fuel injectors include an actuating solenoid that opens a fuel injector nozzle when the solenoid is energized. Fuel is then injected into the combustion chamber as a function of the time period during which the solenoid remains energized and the pressure of fuel supplied to the fuel injector nozzle.

To optimize engine performance and exhaust emissions, engine manufacturers may vary the pressure of the fuel supplied to the fuel injector nozzle. One such example is described in U.S. Patent Application Publication No. 2004/0168673 (the '673 publication) by Shinogle published Sep. 2, 2004. The '673 publication describes a fuel injection system having a fuel injector fluidly connectable to a first common rail and a second common rail. By fluidly connecting the fuel injector to the first common rail, fuel can be injected at a first pressure. By fluidly connecting the fuel injector to the second common rail, fuel can be injected at a second pressure that is independent of the first pressure.

Although the fuel injection system of the '673 publication may adequately supply fuel to an engine at different pressures, it may be expensive. In particular, the two separate fluid rails and associated supply systems increase the number of components of the fuel injection system, which correspondingly increases the complexity and cost of the fuel injection system.

The fuel system of the present disclosure solves one or more of the problems set forth above.

SUMMARY OF THE INVENTION

One aspect of the present disclosure is directed to a fuel injector. The fuel injector includes a nozzle member having at least one orifice and a needle valve element with a tip end. The needle valve element is axially movable to selectively allow and block fuel flow through the at least one orifice with the tip end. The fuel injector also includes at least one supply passageway in communication with the tip end of the needle valve, and a variable restrictive device disposed within the at least one supply passageway.

Another aspect of the present disclosure is directed to a method of injecting fuel into a combustion chamber of an engine. The method includes directing pressurized fuel to at least one orifice of a nozzle member. The method also includes variably restricting the flow of pressurized fluid to the nozzle member to vary the pressure of the fuel injection.

DETAILED DESCRIPTION

Figure 1:
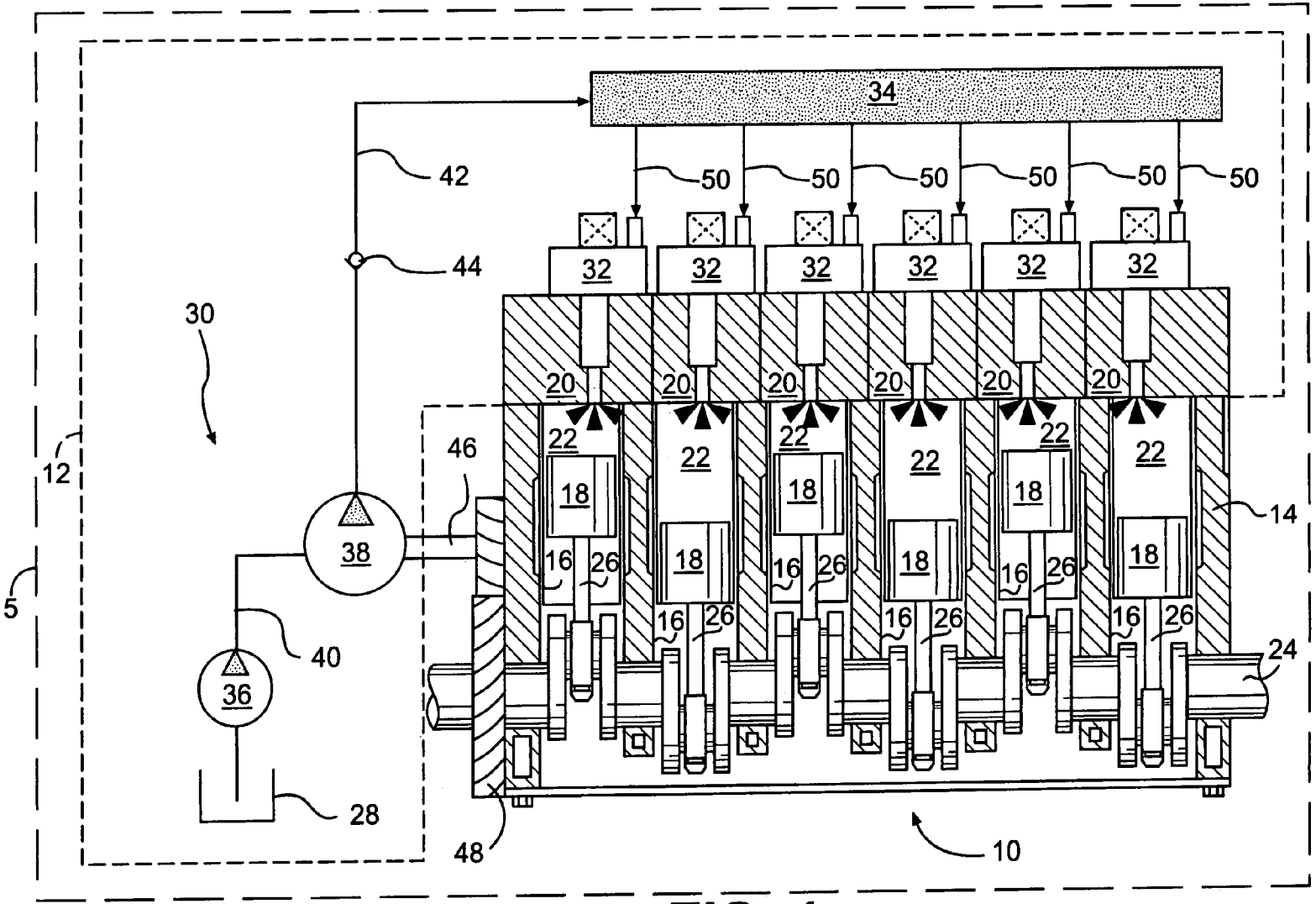
FIG. 1 is a schematic and diagrammatic illustration of an exemplary disclosed fuel system.

FIG. 1 illustrates a work machine 5 having an engine 10 and an exemplary embodiment of a fuel system 12. Work machine 5 may be a fixed or mobile machine that performs some type of operation associated with an industry such as mining, construction, farming, power generation, transportation, or any other industry known in the art. For example, work machine 5 may embody an earth moving machine, a generator set, a pump, or any other suitable operation-performing work machine.

For the purposes of this disclosure, engine 10 is depicted and described as a four-stroke diesel engine. One skilled in the art will recognize, however, that engine 10 may embody any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common rail 34.

Fuel pumping arrangement 30 may include one or more pumping devices that function to increase the pressure of the fuel and direct one or more pressurized streams of fuel to common rail 34. In one example, fuel pumping arrangement 30 includes a low pressure source 36 and a high pressure source 38 disposed in series and fluidly connected by way of a fuel line 40. Low pressure source 36 may embody a transfer pump configured to provide low pressure feed to high pressure source 38. High pressure source 38 may be configured to receive the low pressure feed and to increase the pressure of the fuel to the range of about 30-300 MPa. High pressure source 38 may be connected to common rail 34 by way of a fuel line 42. A check valve 44 may be disposed within fuel line 42 to provide for unidirectional flow of fuel from fuel pumping arrangement 30 to common rail 34.

One or both of low pressure and high pressure sources 36, 38 may be operably connected to engine 10 and driven by crankshaft 24. Low and/or high pressure sources 36, 38 may be drivably connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Figure 2:
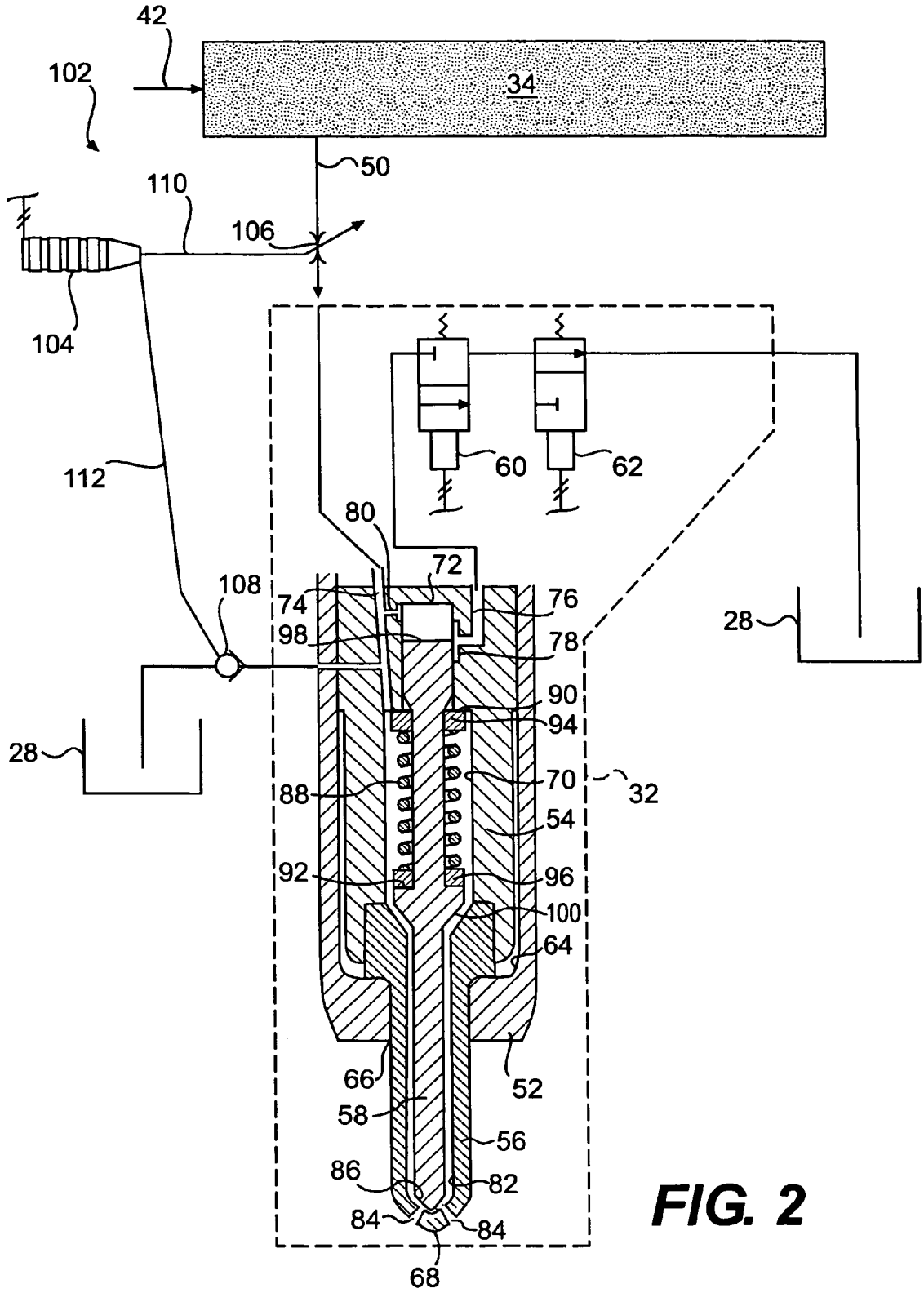
FIG. 2 is a schematic and cross-sectional illustration of an exemplary disclosed fuel injector for the fuel system of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a needle valve element 58, a first solenoid actuator 60, and a second solenoid actuator 62.

Injector body 52 may be a generally cylindrical member configured for assembly within cylinder head 20. Injector body 52 may have a central bore 64 for receiving guide 54 and nozzle member 56, and an opening 66 through which a tip end 68 of nozzle member 56 may protrude. A sealing member such as, for example, an o-ring (not shown) may be disposed between guide 54 and nozzle member 56 to restrict fuel leakage from fuel injector 32.

Guide 54 may also be a generally cylindrical member having a central bore 70 configured to receive needle valve element 58, and a control chamber 72. Central bore 70 may act as a pressure chamber, holding pressurized fuel continuously supplied by way of a fuel supply passageway 74. During injection, the pressurized fuel from fuel line 50 may flow through fuel supply passageway 74 and central bore 70 to the tip end 68 of nozzle member 56.

Control chamber 72 may be selectively drained of or supplied with pressurized fuel to control motion of needle valve element 58. Specifically, a control passageway 76 may fluidly connect a port 78 associated with control chamber 72, and first solenoid actuator 60. Port 78 may be disposed within a side wall of control chamber 72 that is radially oriented relative to axial movement of needle valve element 58 or, alternatively, within an axial end portion of control chamber 72. Control chamber 72 may be continuously supplied with pressurized fuel via a restricted supply passageway 80 that is in communication with fuel supply passageway 74. The restriction of supply passageway 80 may allow for a pressure drop within control chamber 72 when control passageway 76 is drained of pressurized fuel.

Nozzle member 56 may likewise embody a generally cylindrical member having a central bore 82 that is configured to receive needle valve element 58. Nozzle member 56 may further include one or more orifices 84 to allow injection of the pressurized fuel from central bore 82 into combustion chambers 22 of engine 10.

Needle valve element 58 may be a generally elongated cylindrical member that is slidingly disposed within housing guide 54 and nozzle member 56. Needle valve element 58 may be axially movable between a first position at which a tip end 86 of needle valve element 58 blocks a flow of fuel through orifices 84, and a second position at which orifices 84 are open to allow a flow of pressurized fuel into combustion chamber 22.

Needle valve element 58 may be normally biased toward the first position. In particular, each fuel injector 32 may include a spring 88 disposed between a stop 90 of guide 54 and a seating surface 92 of needle valve element 58 to axially bias tip end 86 toward the orifice-blocking position. A first spacer 94 may be disposed between spring 88 and stop 90, and a second spacer 96 may be disposed between spring 88 and seating surface 92 to reduce wear of the components within fuel injector 32.

Needle valve element 58 may have multiple driving hydraulic surfaces. In particular, needle valve element 58 may include a hydraulic surface 98 tending to drive needle valve element 58 toward the first or orifice-blocking position when acted upon by pressurized fuel, and a hydraulic surface 100 that tends to oppose the bias of spring 88 and drive needle valve element 58 in the opposite direction toward the second or orifice-opening position.

First solenoid actuator 60 may be disposed opposite tip end 86 of needle valve element 58 to control the opening motion of needle valve element 58. In particular, first solenoid actuator 60 may include a two-position valve element disposed between control chamber 72 and tank 28. The valve element may be spring-biased toward a closed position blocking fluid flow from control chamber 72 to tank 28, and solenoid-actuated toward an open position at which fuel is allowed to flow from control chamber 72 to tank 28. The valve element may be movable between the closed and open positions in response to an electric current applied to a coil associated with first solenoid actuator 60. It is contemplated that the valve element may alternatively be hydraulically operated, mechanically operated, pneumatically operated, or operated in any other suitable manner. It is further contemplated that the valve element may alternatively embody a proportional type of valve element that is movable to any position between the closed and open positions.

Second solenoid actuator 62 may include a two-position valve element disposed between first solenoid actuator 60 and tank 28 to control a closing motion of needle valve element 58. The valve element may be spring-biased toward an open position at which fuel is allowed to flow to tank 28, and solenoid-actuated toward a closed position blocking fluid flow to tank 28. The valve element may be movable between the open and closed positions in response to an electric current applied to a coil associated with second solenoid actuator 62. It is contemplated that the valve element may alternatively be hydraulically operated, mechanically operated, pneumatically operated, or operated in any other suitable manner. It is further contemplated that the valve element may alternatively embody a three-position type of valve element, wherein bidirectional flows of pressurized fuel is facilitated.

As also illustrated in FIG. 2, a pressure control device 102 may be associated with each fuel injector 32. Specifically, pressure control device 102 may include an actuator 104, a variable restrictive device 106, and a check valve 108. Actuator 104 may be mechanically or hydraulically connected to variable restrictive device 106 by way of a communication link 110, and to check valve 108 by way of a communication link 112.

Actuator 104 may embody a piezo electric mechanism having one or more columns of piezo electric crystals. Piezo electric crystals are structures with random domain orientations. These random orientations are asymmetric arrangements of positive and negative ions that exhibit permanent dipole behavior. When an electric field is applied to the crystals, such as, for example, by the application of a current, the piezo electric crystals expand along the axis of the electric field as the domains line up.

Actuator 104 may be connected to mechanically or hydraulically control the motion of variable restrictive device 106 and check valve 108. For example, as a current is applied to the piezo electric crystals of actuator 104, actuator 104 may affect movement of variable restrictive device 106 via communication link 110 to decrease the restriction of pressurized fluid flowing to fuel injector 32. Substantially simultaneously, actuator 104 may block check valve 108 in a flow blocking position via communication link 112. In contrast, as the current is removed from the piezo electric crystals of actuator 104, actuator 104 may move variable restrictive device 106 via communication link 110 to increase the restriction of pressurized fluid flowing to fuel injector 32. Substantially simultaneously, actuator 104 may unblock check valve 108 via communication link 112. It is contemplated that the piezo electric crystals of actuator 104 may be omitted, if desired, and the movement of variable restrictive device 106 and check valve 108 be controlled in another suitable manner. It is further contemplated that a single actuator 104 and/or a single variable restrictive device 106 may be associated with multiple fuel injectors 32 to reduce the number of components included within fuel system 12.

Variable restrictive device 106 may be located within fuel line 50 or fuel supply passageway 74 to restrict the flow of pressurized fuel. For example, variable restrictive device 106 may include a proportional valve element or other suitable device movable by actuator 104 to restrict the flow of fuel to central bore 82 of nozzle member 56. The amount of restriction may be dependent on the current applied to the piezo electric crystals of actuator 104. This restriction of pressurized fuel may allow for a variable pressure of fuel with central bore 82, resulting in a variable injection rate of fuel through orifices 84 and penetration depth into combustion chamber 22.

Check valve 108 may be situated for unidirectional flow of fuel from fuel supply passageway 74 to tank 28. Because the blocking or unblocking of check valve 108 is affected by the motion of actuator 104 and related to the restriction of variable restrictive device 106, fuel flow through check valve 108 to tank 28 may only be permitted between injection events. In this manner, a substantially constant reference pressure may be maintained within central bore 82. It is contemplated that check valve 108 may be omitted, if desired, and an additional 2-way type of valve alternatively included.

Figure 3:
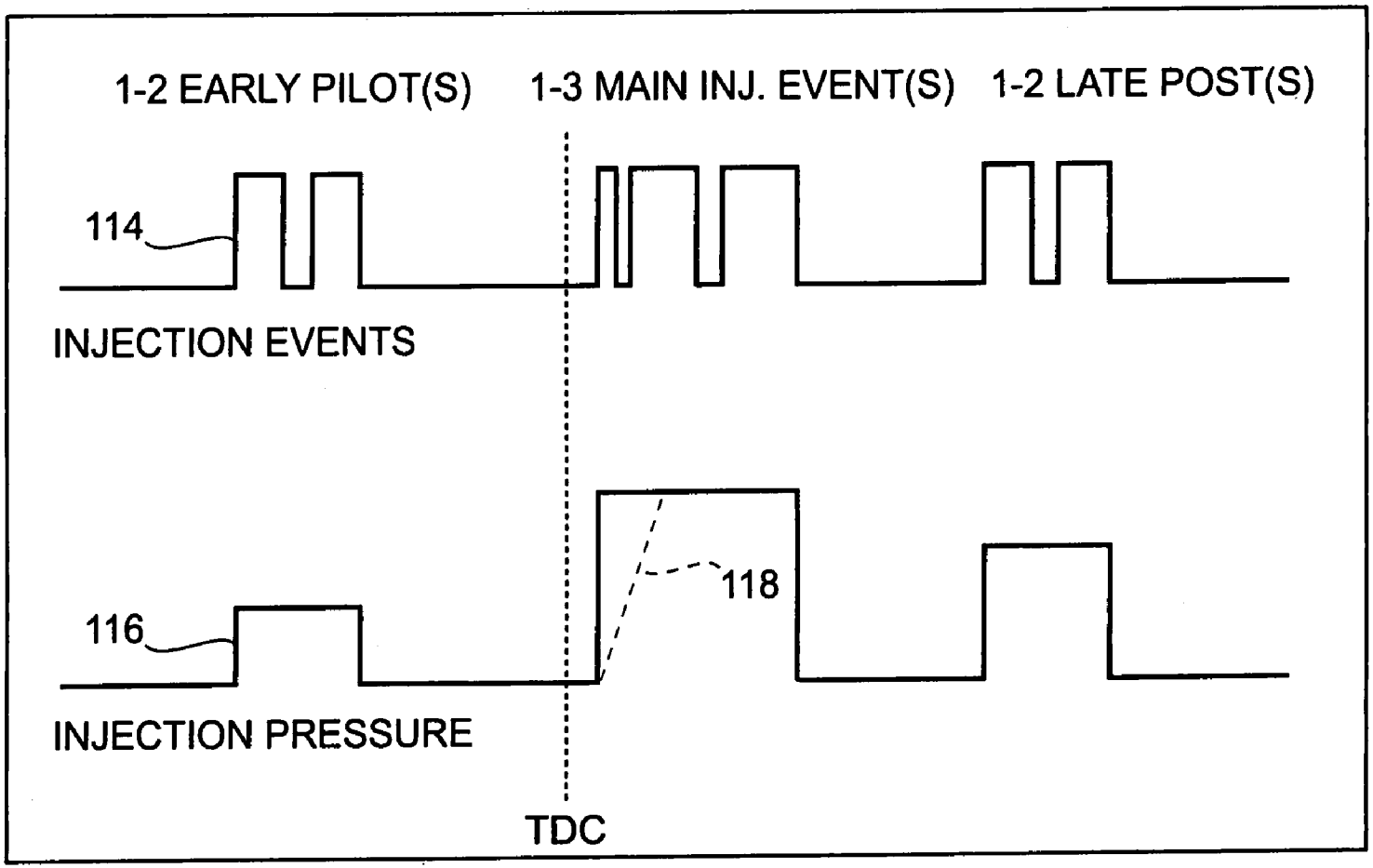
FIG. 3 is a graph depicting an exemplary operation of the fuel injector of FIG. 2.

FIG. 3 illustrates an exemplary operation of fuel system 12. FIG. 3 will be discussed in the following section to further illustrate the disclosed system and its operation.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine that utilizes a pressurizing fuel system wherein it may be advantageous to provide a variable pressure supply of fuel. The operation of fuel system 12 will now be explained.

Needle valve element 58 may be moved by an imbalance of force generated by fuel pressure. For example, when needle valve element 58 is in the first or orifice-blocking position, pressurized fuel from fuel supply passageway 74 may flow into control chamber 72 to act on hydraulic surface 98. Simultaneously, pressurized fuel from fuel supply passageway 74 may flow into central bores 70 and 82 in anticipation of injection. The force of spring 88 combined with the hydraulic force generated at hydraulic surface 98 may be greater than an opposing force generated at hydraulic surface 100 thereby causing needle valve element 58 to remain in the first position to restrict fuel flow through orifices 84. To open orifices 84 and inject the pressurized fuel from central bore 82 into combustion chamber 22, first solenoid actuator 60 may move its associated valve element to selectively drain the pressurized fuel away from control chamber 72 and hydraulic surface 98. This decrease in pressure acting on hydraulic surface 98 may allow the opposing force acting across hydraulic surface 100 to overcome the biasing force of spring 88, thereby moving needle valve element 58 toward the orifice-opening position.

To close orifices 84 and end the injection of fuel into combustion chamber 22, second solenoid actuator 62 may be energized. In particular, as the valve element associated with second solenoid actuator 62 is urged toward the flow blocking position, fluid from control chamber 72 may be prevented from draining to tank 28. Because pressurized fluid is continuously supplied to control chamber 72 via restricted supply passageway 80, pressure may rapidly build within control chamber 72 when drainage through control passageway 76 is prevented. The increasing pressure within control chamber 72, combined with the biasing force of spring 88, may overcome the opposing force acting on hydraulic surface 100 to force needle valve element 58 toward the closed position. It is contemplated that second solenoid actuator 62 may be omitted, if desired, and first solenoid actuator 60 used to initiate both the opening and closing motions of needle valve element 58.

Actuator 104 may affect the pressure of the fluid supplied to central bores 70 and 82, and injected into combustion chamber 22. Specifically, in response to a current applied to the piezo electric crystals of actuator 104, actuator 104 may affect movement of variable restrictive device 106 via communication link 110 to increase or decrease the restriction on the fluid flowing into fuel injector 32. This change in the restriction may directly affect the pressure drop across variable restrictive device 106 and resulting pressure of fuel within central bores 70 and 82. For example, an increased current applied to actuator 104 may cause a decrease in restriction of variable restrictive device 106 and a resulting higher pressure of fuel within central bores 70 and 82. In contrast, a decreased current applied to actuator 104 may cause an increase in restriction of variable restrictive device 106 and a resulting lower pressure of fuel within central bores 70 and 82.

The pressure of the fuel supplied to central bores 70 and 82, and injected into combustion chamber 22 may be varied throughout a single injection cycle (e.g., the cycle of injections occurring during the four strokes of piston 18) or even during a single injection event. Specifically, as illustrated in FIG. 3, a first curve 114 may represent various injection events occurring within a single injection cycle, while a second curve 116 may represent the pressure of the fuel injected during each of the injection events. As can be seen from first and second curves 114, 116, two pilot injections of fuel at a first pressure are illustrated as occurring before piston 18 has reached top dead center (TDC), three main injections of fuel at a second pressure are illustrated as occurring shortly after piston 18 has reached TDC, and two post injections of fuel at a third pressure are illustrated as occurring late in the downward stroke of piston 18. As illustrated by a dashed line 118 associated with second curve 116, the pressure within a single injection event may also be varied by changing the restriction of variable restrictive device 106 during the injection event. It is to be noted that the injection events depicted within FIG. 3 are exemplary only and that any number of injections may implemented at any suitable timing relative to the motion of piston 18. It also contemplated that the relative pressure magnitudes depicted by second curve 116 may be modified, as desired.

Because fuel system 12 may vary the pressure of injected fuel by changing the restriction placed on fuel supplied to fuel injectors 32, the number of different levels of fuel pressure available for injection may be infinite. In particular, fuel system 12 is not limited to specific predetermined pressure levels. This flexibility in the pressure of injected fuel may extend the use of fuel system 12 to different applications, as well as extending the operational range and efficiency of engine 10. In addition, this flexibility may allow compliance with emission standards under a wider range of operating conditions.

Further, because fuel system 12 may vary the pressure of injected fuel with a minimal number of additional components, the complexity and cost of fuel system 12 may be low. Specifically, the addition of actuator 104, variable restrictive device 106, and check valve 108 may add very little complexity or cost to fuel system 12.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel injector, comprising:

a nozzle member having at least one orifice;

a needle valve element having a tip end, the needle valve element axially movable to selectively allow and block fuel flow through the at least one orifice with the tip end;

at least one supply passageway in communication with the tip end of the needle valve;

a variable restrictive device disposed within the at least one supply passageway;

a check valve disposed downstream of the at least one supply passageway; and an actuator configured to mechanically or hydraulically control a motion of the variable restrictive device and the check valve.

2. The fuel injector of claim 1, wherein the actuator is configured to vary the restriction of fuel flow through the at least one supply passageway.

3. The fuel injector of claim 1, wherein the actuator includes at least one piezo electric element.

4. The fuel injector of claim 1, wherein the check valve is disposed between the at least one supply passageway and a drain.

5. The fuel injector of claim 4, wherein the check valve is configured to selectively allow unidirectional flow of fluid from the at least one supply passageway to the drain.

6. The fuel injector of claim 5, wherein the actuator is operatively connected to the check valve to selectively block the check valve from opening.

7. The fuel injector of claim 6, wherein the actuator is configured to block the check valve from opening during an injection event.

8. The fuel injector of claim 6, wherein the actuator is configured to unblock the check valve when the restriction through the variable restrictive device is at a minimum.

9. A method of injecting fuel into a combustion chamber of an engine, the method comprising:

directing pressurized fuel to at least one orifice of a nozzle member;

variably restricting the flow of pressurized fluid to the nozzle member proportionally to an applied electric stimulus to vary the pressure of the fuel injection; and moving, substantially simultaneously with restriction of the flow of pressurized fluid to the nozzle member proportionally to the applied electric stimulus, a valve element disposed downstream of the nozzle member.

10. The method of claim 9, wherein variably restricting includes changing the restriction of the flow of pressurized fluid between injection events.

11. The method of claim 9, wherein variably restricting includes changing the restriction of the flow of pressurized fluid during an injection event.

12. The method of claim 9, wherein variably restricting includes applying a current to at least one piezo electric element.

13. The method of claim 9, further including selectively draining the pressurized fluid from the nozzle member between injection events.

14. The method of claim 13, wherein draining the pressurized fluid includes moving the valve element in response to a pressure of the fluid within the nozzle member.

15. The method of claim 14, further including blocking the valve element from movement during an injection event.

16. The method of claim 15, wherein:

variably restricting includes applying a current to at least one piezo electric element; and applying the current to the at least one piezo electric element causes the valve element to be blocked from movement.

17. A machine, comprising:

an engine configured to generate a power output, the engine having at least one combustion chamber;

at least one pumping element configured to pressurize a fuel; and a fuel injector configured to inject the pressurized fuel into the at least one combustion chamber of the engine, the fuel injector including:

a nozzle member having at least one orifice;

a needle valve element having a tip end, the needle valve element axially movable to selectively allow and block fuel flow through the at least one orifice with the tip end;

at least one supply passageway in communication with the tip end of the needle valve;

a variable restrictive device disposed within the at least one supply passageway;

a check valve disposed between the at least one supply passageway and a drain, the check valve being configured to allow unidirectional flow of fluid from the at least one supply passageway to the drain; and an actuator operatively coupled to the variable restrictive device and the check valve, the actuator configured to vary the restriction of fuel flow through the at least one supply passageway and to selectively block the check valve from opening.

18. The machine of claim 17, wherein the actuator includes at least one piezo electric element.

19. The machine of claim 17, wherein the actuator is configured to block the check valve from opening during an injection event.

20. The machine of claim 17, wherein the actuator is configured to unblock the check valve when the restriction through the variable restrictive device is at a minimum.

* * * * *